US010945536B1

(12) United States Patent
Alexander

(10) Patent No.: US 10,945,536 B1
(45) Date of Patent: Mar. 16, 2021

(54) INFANT CHANGING POD

(71) Applicant: CheBebe, LLC, Brooklyn, NY (US)

(72) Inventor: Unika Alexander, Brooklyn, NY (US)

(73) Assignee: Chebebe, Brooklyn, NY (US)

( * ) Notice: Subject to any disclaimer, the term of this patent is extended or adjusted under 35 U.S.C. 154(b) by 310 days.

(21) Appl. No.: 16/128,959

(22) Filed: Sep. 12, 2018

(51) Int. Cl.
*A47D 5/00* (2006.01)
*A47D 7/01* (2006.01)

(52) U.S. Cl.
CPC . *A47D 5/00* (2013.01); *A47D 7/01* (2013.01)

(58) Field of Classification Search
CPC ..... A47D 5/00; A47D 7/01; A47D 13/083; A47D 15/005; A47D 7/007; A47D 5/003; A47D 5/006; A47K 3/024; A47K 3/064; A47K 3/034; A47K 3/074; A47K 3/127; E05D 1/02; E05C 3/124; A47B 88/493; A47B 88/969
See application file for complete search history.

(56) References Cited

U.S. PATENT DOCUMENTS 3,532,336 A * 10/1970 Baker ..... A61G 13/12 5/650
4,183,596 A * 1/1980 Greene ..... A47B 88/493 312/286
4,522,381 A * 6/1985 Ludwick ..... A47D 5/00 5/424
5,161,270 A * 11/1992 Najmabadi ..... A47D 5/00 128/869
5,628,552 A * 5/1997 O'Barr ..... A47B 88/969 312/330.1
5,795,044 A * 8/1998 Trewhella, Jr. ..... A47B 88/57 292/87
6,256,803 B1 * 7/2001 Sauerbrei ..... A47D 5/003 4/443
6,405,394 B1 * 6/2002 Rosenberg ..... A47D 15/003 5/655

(Continued)

FOREIGN PATENT DOCUMENTS

DE 202006009096 U1 * 10/2007 ..... B25H 3/028
FR 2896968 A1 * 8/2007 ..... A47D 5/00

(Continued)

*Primary Examiner* — Robert G Santos
*Assistant Examiner* — Alison N Labarge
(74) *Attorney, Agent, or Firm* — Eric Karich; Karich & Associates

(57) ABSTRACT

A changing pod for an infant has a bed member for supporting an infant in a lying condition. The bed member has an infant support surface partially sloping downwardly towards a foot end of the bed member, and raised walls extending upwardly from the infant support surface for securing the infant thereon. A gully for operatively directing fluid runoff from the infant support surface and over the foot end of the bed member is defined by a break in the raised walls located near the foot end of the bed member. The bed member is receivable on a base member. The base member defines first and second cavities, within which respective first and seconds drawers are slidably movable along axes being transverse one another. The first drawer is shaped and sized such that even when in a retracted condition within the first cavity, at least a portion of an upper open end thereof extends longitudinally beyond the foot end of the bed member.

16 Claims, 4 Drawing Sheets

(56) References Cited

U.S. PATENT DOCUMENTS

| | | | | |
|---|---|---|---|---|
| 6,928,680 | B1 * | 8/2005 | Cai | A47D 5/00 5/655 |
| 10,149,550 | B1 * | 12/2018 | Bain | A47D 5/006 |
| 2008/0060135 | A1 * | 3/2008 | Wong | A47D 5/00 5/655 |
| 2018/0177308 | A1 * | 6/2018 | Heimbuch | A47D 5/00 |

FOREIGN PATENT DOCUMENTS

| | | | | |
|---|---|---|---|---|
| KR | 200449867 | Y1 * | 8/2010 | A47D 5/006 |
| WO | WO-2016059362 | A2 * | 4/2016 | A47D 15/00 |

* cited by examiner

INFANT CHANGING POD

BACKGROUND OF THE INVENTION

Field of the Invention

This invention relates generally to infant products that facilitate changing diapers, and more particularly to an infant changing pod.

Description of Related Art

The prior art teaches of changing pods for infants, more specifically changing pods for infants having a bed member that allows an infant to be supported while the infant's diaper is being changed.

The prior art also teaches of base members of such changing pods having a container for storing water that can be used to clean the infant after the parent removes the infant's soiled diaper. For example, Cai et al., U.S. Pat. No. 6,928,680, teaches a baby changing product that includes a pad which may be moved to expose a container for holding warm water.

There is a need to provide a changing pod for an infant, that directs excess water, used while cleaning and changing an infant's diaper, away from the support surface on which the infant is supportable. By configuring a bed member that has an infant support surface that partially slopes towards a gully, which is located at the foot of the bed member, together with a removable first drawer into which the gully directs fluid runoff, such needs and further advantages as described in the summary following are fulfilled.

SUMMARY OF THE INVENTION

The present invention teaches certain benefits in construction and use which give rise to the objectives described below.

The present invention provides a changing pod for an infant comprising a bed member for supporting the infant in a lying condition, and a base member having two containers for holding water. The bed member has a head end, an opposing foot end, a pair of opposing sides. An infant support surface at least partially slopes downwardly towards the foot end of the bed member and raised walls extending upwardly from the infant support surface for operatively restricting the infant from rolling off the infant support surface. The raised walls extend substantially about the periphery of the bed member defining, at a break therein near the foot end of the bed member, a gully for operatively directing fluid runoff from the infant support surface over the foot end of the bed member. The base member is shaped to receive the bed member, the base member comprising a head end, an opposing foot end, a pair of opposing sides and a base surface on which the base member is operatively supportable.

In one embodiment, the base member defines a first cavity extending from the foot end of the base member backwardly toward the head end thereof along a longitudinal axis passing through such foot and head ends of the base member; and a second cavity extending from one of the sides of the base member towards the opposing side thereof along a transverse axis passing through the sides of base member.

In one embodiment, a first drawer defines an upper open end through which fluid runoff from the bed member is receivable within the first drawer, the first drawer being slidably movable along the first cavity between a retracted condition, wherein the first drawer is located substantially within the first cavity thereby to substantially conceal the upper open end of the first drawer, and an extended condition, wherein the first drawer extends substantially beyond the foot end of the base member and/or is movable entirely free therefrom thereby to expose the upper open end of the first drawer. A second drawer is slidably movable along the second cavity between a retracted condition, wherein the second drawer is located substantially within the second cavity, and an extended condition, wherein the second drawer extends substantially beyond the side of the base member and/or is movable entirely free therefrom. The first drawer is shaped and sized such that even when the first drawer is in the retracted condition, at least a portion of the upper open end thereof extends longitudinally beyond the foot end of the bed member, thereby to capture fluid runoff operatively falling there over.

A primary objective of the present invention is to provide a changing pod for an infant having advantages not taught by the prior art.

Another objective is to provide a changing pod wherein the infant support surface that at least partially slopes downwardly towards the foot end of the bed member.

Another objective is to provide a changing pod that includes a pair of containers for holding water.

A further objective is to provide a changing pod that includes a base member that defines a first cavity extending from the foot end of the base member backwardly toward the head end thereof along a longitudinal axis, and a second cavity that extends across both of the sides of the base member.

Another objective is to provide a changing pod wherein the second drawer is divided into two or more compartments, each of the compartments having a lid movable, relative to a respective opening therein, between an open condition, wherein a user is provided access to contents stored within the compartment, and a closed condition, wherein the contents is inaccessibly contained within the closed compartment.

Yet a further objective is to provide a changing pod including one or more light sources spaced from another at least about the head end of the base member, the light sources being powered by a rechargeable power source housed in the base member.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a changing pod for an infant.

Figure 1:
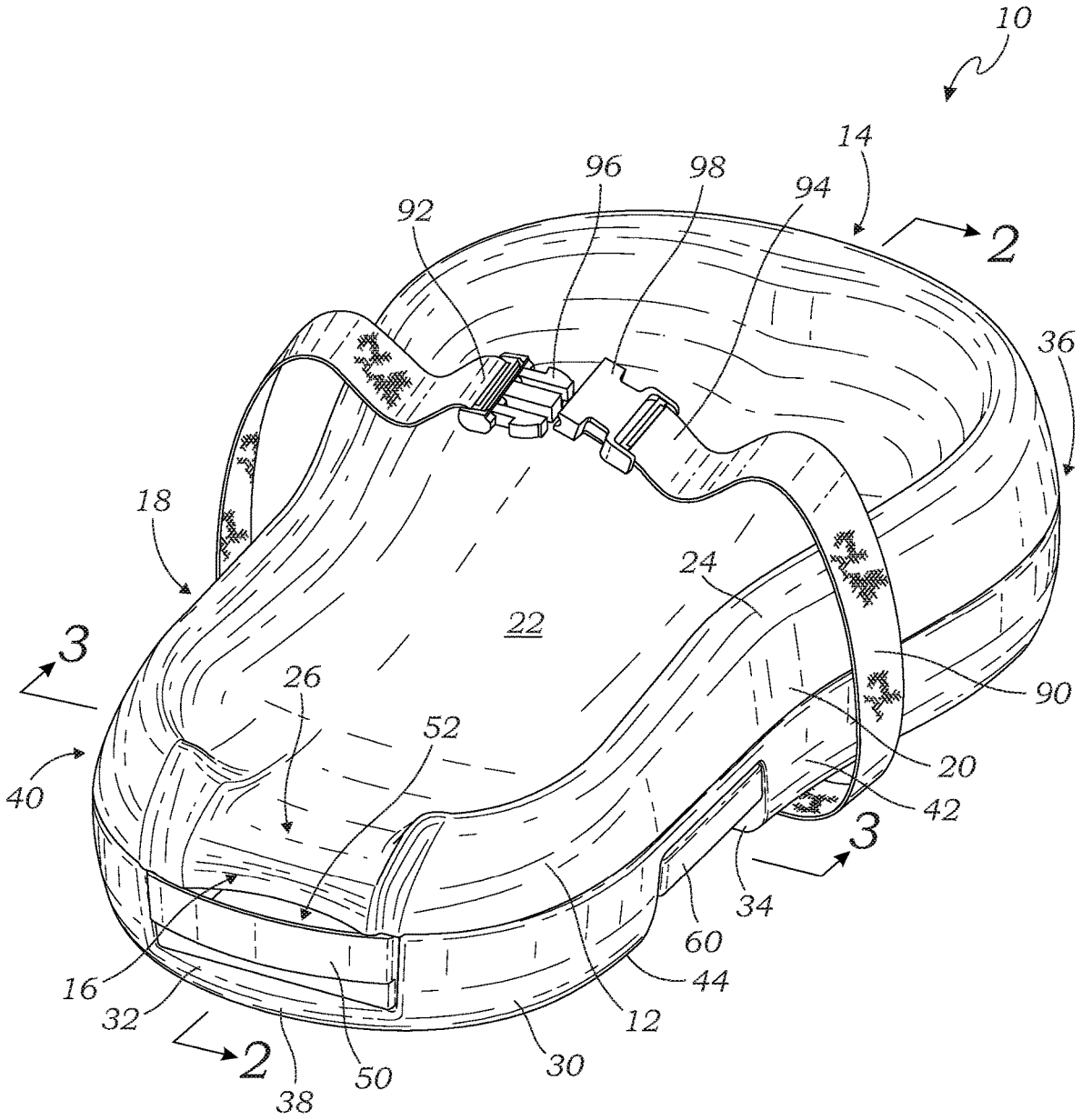
FIG. 1 is a perspective view of a changing pod for an infant according to one embodiment of the present invention.

FIG. 1 is a perspective view of one embodiment of a changing pod 10. As shown in FIG. 1, in this embodiment the changing pod 10 comprises a bed member 12, a base member 30 on which the bed member 12 is supported, a first drawer 50 slidably movable within a first cavity 32 defined in the base member 30, and a second drawer 60 slidably movable within a second cavity 34 defined in the base member 30.

With reference to FIG. 1, the bed member 12 comprises a head end 14, an opposing foot end 16, a pair of opposing sides 18, 20 and an infant support surface 22 on which the infant is supportable, at least partially sloping downwardly towards the foot end 16 of the bed member 12.

The bed member 12 further comprises raised walls 24 extending upwardly from the infant support surface 22 for operatively restricting the infant, in use lying with its head located nearest to the head end 14 of bed member 12, from rolling off the infant support surface 22. The raised walls 24 extend substantially about the periphery of the bed member 12, defining at a break therein, near the foot end 16 of the bed member 12, a gully 26 for operatively directing fluid runoff from the infant support surface 22, over the foot end 16 of the bed member 12 and into the first drawer 50 located there beneath.

The infant support surface 22 of the bed member 12 may be padded for comfortably supporting the infant. The infant support surface 22 may further be made from a slip resistant material to further secure the infant, particularly when wet. In one embodiment, the bed member 12 is an integrally formed foam rubber or plastic material. In alternative embodiments, other materials and constructions may be used, and alternative constructions known in the art should be considered within the scope of the present invention.

The base member 30 comprises a head end 36, an opposing foot end 38, a pair of opposing sides 40, 42 and a base surface 44 on which the base member 30 is operatively supportable on a support surface. The base member 30 is shown more fully in FIG. 7, and is discussed in greater detail below.

Figure 2:
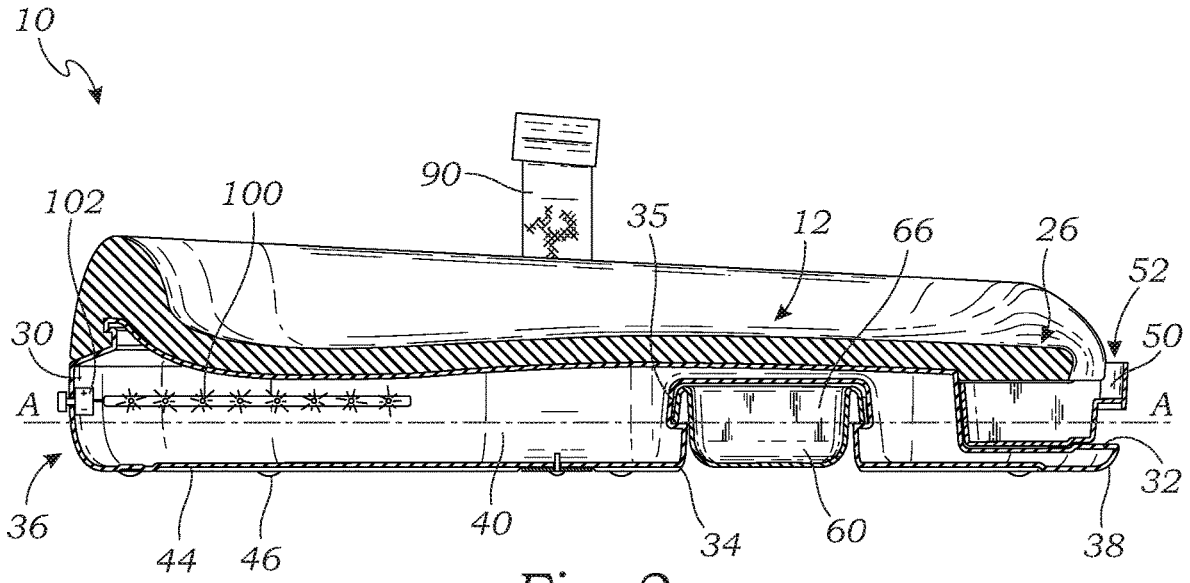
FIG. 2 is a sectional view thereof taken along line 2-2 of FIG. 1.

FIG. 2 is a sectional view thereof taken along line 2-2 of FIG. 1. As shown in FIG. 2, the first cavity 32 extends from the foot end 38 of the base member 30 backwardly toward the head end 36 thereof along a longitudinal axis A-A passing through such head and foot ends 36, 38 of the base member 30. The first drawer 50 defines an upper open end 52 through which fluid runoff from the bed member 12, directed thereto via the gulley 26, is receivable within the first drawer 50. The first drawer 50 is sized and shaped to fit into the first cavity 32. In this embodiment, the first drawer 50 is slidably movable along the first cavity 32 between a retracted condition and an extended condition.

In the retracted condition, the first drawer 50 is located substantially within the first cavity 32 thereby to substantially conceal the upper open end 52 of the first drawer 50. In the extended condition, the first drawer 50 extends substantially beyond the foot end 38 of the base member 30 and/or is movable entirely free therefrom thereby to expose the upper open end of the first drawer 50, such that the contents collected in use in the first drawer 50 can be discarded. It will be appreciated that the first drawer 50 is shaped and sized such that even when the first drawer 50 is in the retracted condition, at least a portion of the upper open end thereof 52 extends longitudinally beyond the foot end 16 of the bed member 12.

In the embodiment of FIG. 2, the bed member 12 is removably mounted upon the base member 30, via interlocking structures that enable the two to be attached or removed as needed. In alternative embodiments, the bed member 12 may be attached to the base member 30 in other ways known in the art, such as via fasteners, or via more permanent methods (e.g., heat welding, adhesives, etc.).

As shown in FIG. 2, the base surface 44 may have located thereon a plurality of non-slip feet 46 to restrict movement of the changing pod 10 relative to the support surface.

Figure 3:
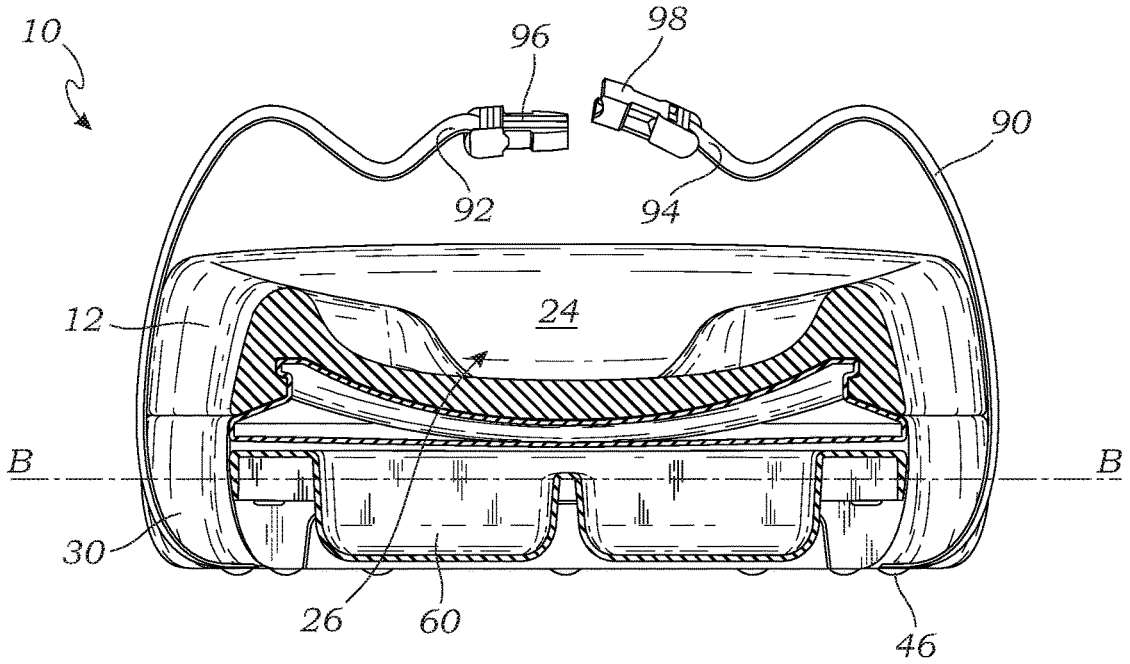
FIG. 3 is a sectional view thereof taken along line 3-3 of FIG. 1.

FIG. 3 is a sectional view thereof taken along line 3-3 of FIG. 1. As shown in FIG. 3, the second cavity 34 extends through both of the sides 40, 42 of the base member 30 along a transverse axis B-B passing through the sides 40, 42 of base member 30, which transverse axis B-B may be orthogonal with the longitudinal axis A-A. The second drawer 60 is sized and shaped to fit into the second cavity 34, in this embodiment it is slidably movable along the second cavity 34 between a retracted condition and an extended condition. In the retracted condition, the second drawer 60 is located substantially within the second cavity 34. In the extended condition, the second drawer 60 extends substantially beyond either of the sides 40, 42 of the base member 30, and/or is movable entirely free therefrom for the purposes of filling with content, i.e. water.

Figure 4:
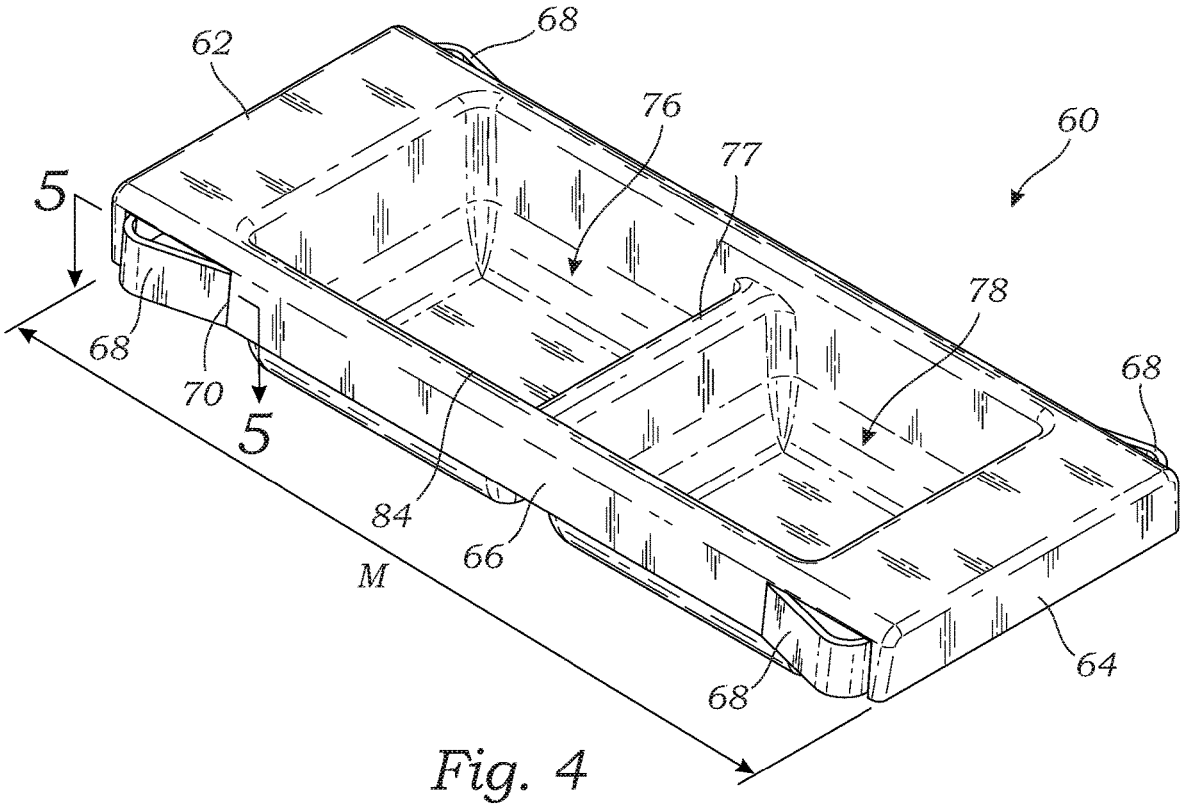
FIG. 4 is a perspective view of a second drawer that is slidably movable within a second cavity of the changing pod.

FIG. 4 is a perspective view of the second drawer 60 that is shaped to fit into the second cavity 34 of the changing pod 10. In this embodiment, the second cavity 34 slidably movable within the second cavity 34. As shown in FIG. 4, the second drawer 60 is cuboidal in shape having a major dimension M as measured across its opposing retractable ends 62, 64 substantially the same as the width W of the base member 30 at the location thereon at which the second cavity 34 is defined.

In this embodiment, as is most clearly illustrated in FIG. 2, the second cavity 34 and the second drawer 60 may be correspondingly substantially T-shaped, with an upper portion 66 of the second drawer 60 being operably captured by and slidable along an upper portion 35 of the second cavity 34.

Figure 5:
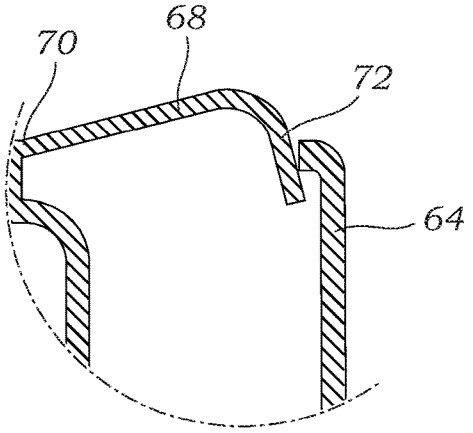
FIG. 5 is a close-up view of a retention finger taken along line 5-5 of FIG. 4.
Figure 6:
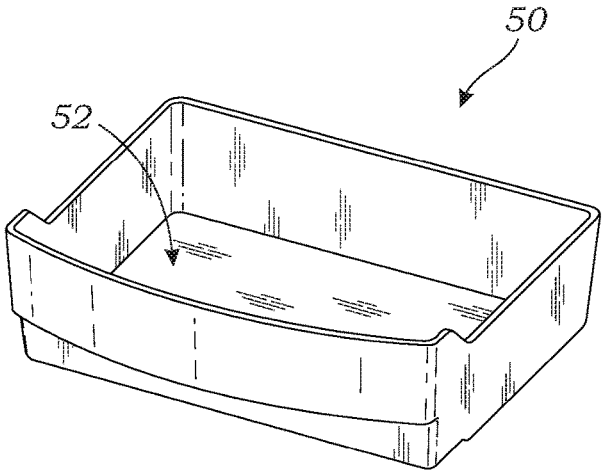
FIG. 6 is a perspective view of a first drawer that is slidably movable within a first cavity of the changing pod.

As is illustrated in FIG. 4 and FIG. 5, the second drawer 60 may include a plurality of retention fingers 68 for providing a biasing force to maintain the second drawer 60 within the base, and help prevent it from falling out, while still allowing the second drawer 60 to be readily pulled out when desired. In this embodiment, the retention fingers 68 are laterally movable between inward and outward positions relative to the second drawer 60, to seat into retention sockets 48 (shown in FIG. 7), as discussed in greater detail below.

In this embodiment, the retention fingers 68 are integral with the second drawer 60, and laterally movable between the inward and outward positions about respective living hinges 70, although other forms of hinges may also be used in other embodiments. The retention fingers 68 of this embodiment may be resiliently biased towards the outward position, and frictionally ride along the upper portion 35 of the second cavity 34 so as to support the second drawer 60 within the second cavity 34 whether operably in the retracted or extended conditions.

Figure 7:
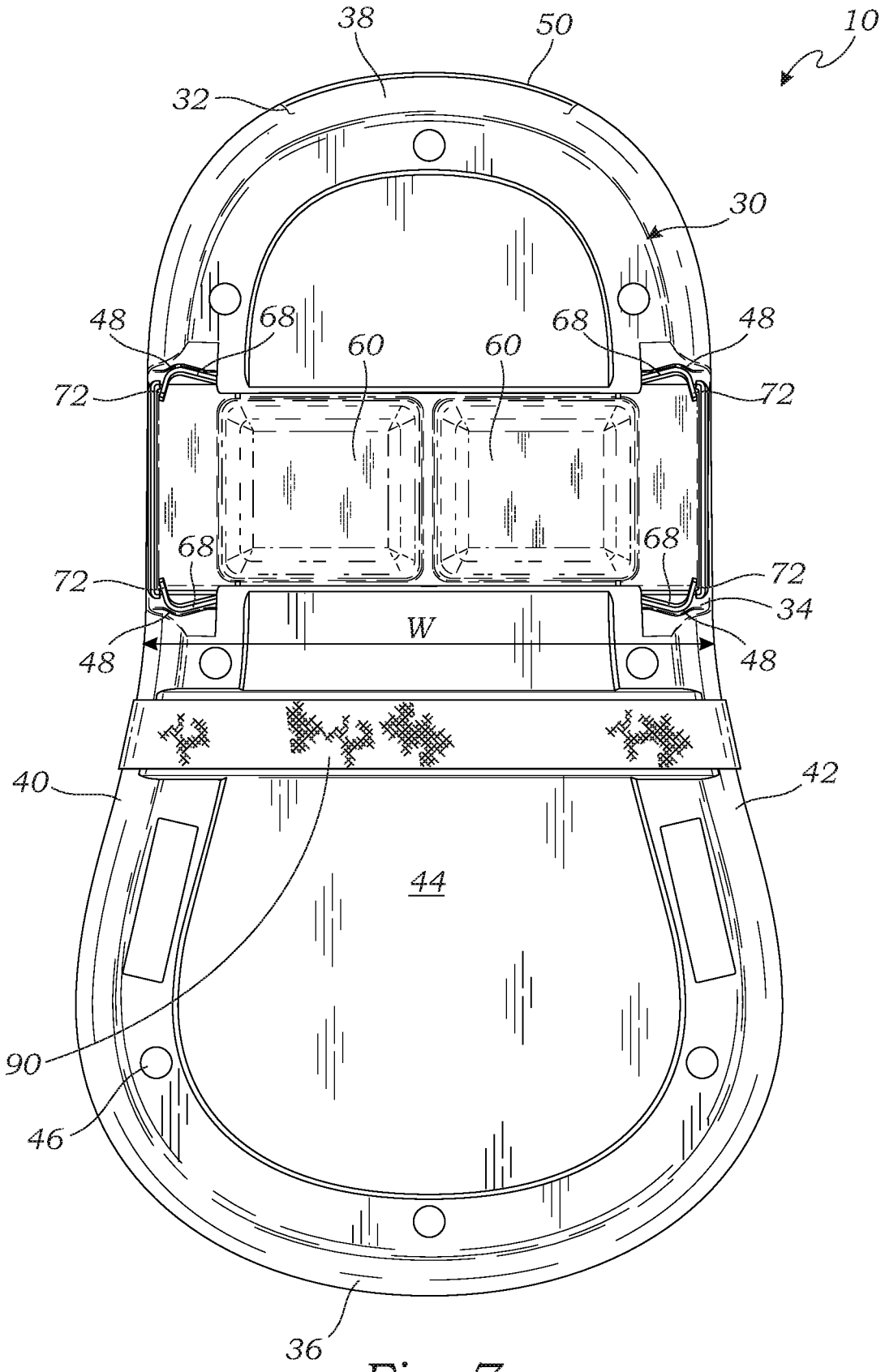
FIG. 7 is a bottom view of the changing pod.

Referring now to FIG. 7, the base member 30, near each of its opposing sides 40, 42 and located within the second cavity 34 thereof, defines retention sockets 48 in which the first free ends 72 of the retention fingers 68 are releasably receivable such that with the second drawer 60 in the fully retracted condition, the retention fingers 68 releasably lock the second drawer 60 in the base member 30.

In the embodiment of FIG. 4 and FIG. 5, the retention fingers 68 are located near each of four corners of the second drawer 60; however, in alternative embodiments, the retention fingers 68 may alternatively be positioned in other locations (e.g., closer to the center), and may be included in different numbers (one or more). In this embodiment, they are configured such that free ends 72 of each of the retention fingers 68 lie closer to the opposing retractable ends 62, 64 of the second drawer 60, as compared to the hinge 70 of each of the retention fingers 68 lying closer to the middle of the major dimension M of the second drawer 60. The free end 72 allows movement of the retention socket 48 to engage or disengage, as discussed above. In use, and on the application of sufficient force exerted by a user on one of the opposing retractable ends 62, 64 of the second drawer 60, the retention fingers 68 are forced inwardly thereby to release from the retention sockets 48 so as to enable sliding movement of the second drawer 60 into the extended condition.

In the embodiment of FIG. 4, the second drawer 60 may be divided, via a divider wall 77, into two compartments 76, 78, although in alternative embodiments this may not be the case, or it may be divided in other configurations. Each of the compartments 76, 78, may further include a lid (not shown) which may be hingedly movable, relative to a respective opening in such compartments, between an open condition and a closed condition.

The lids may seal against a rim 84 of the compartment opening thereby to contain fluids in the compartments 76, 78 in a water-tight fashion. The changing pod 10 further includes a means for releasably securing the infant on the bed member 12. The releasable securing means may include an adjustable strap 90, anchored to the base member 30 and including, at each free end 92, 94 thereof, co-operating clips 96, 98 for securing the strap 90 in a closed loop fashion operably about the body of the infant, thereby to secure the infant in position on the bed member 12. In alternative embodiments, the releasable securing means may include other forms of straps, harnesses, tethers, etc., and such alternatives should be considered within the scope of the present invention.

The changing pod 10 also includes light sources 100, in this embodiment including one or more light-emitting diodes (LEDs), spaced from one another about the head end 36 of the base member 30, thereby to provide ambient lighting. The intensity of the light source 100 is adjustable by an adjusting means, i.e. a knob 102, also located on the base member 30. It will be appreciated that the electrics of the changing pod 10 are powered by an on-board power source, such as rechargeable batteries.

In use during a diaper change, with the infant strapped to the changing pod 10 and with at least one of the compartments 76, 78 filled with water, the second drawer 60 is movable by the user (i.e. a parent) from the retracted condition to the extended condition sufficiently to enable access to the water. While cleaning the infant, soiled water is directed by the gulley 26 downwardly along the infant support surface 22 of the bed member 12 and over the foot end 16 thereof, to be captured in the first drawer 50. Once the diaper has been changed, the first drawer 50 is slid out from the first cavity 32 such that the contents of the first drawer 50 can be disposed of.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A changing pod for an infant, the changing pod comprising:

a bed member for supporting the infant in a lying condition, the bed member having a head end, an opposing foot end, a pair of opposing sides, an infant support surface at least partially sloping downwardly towards the foot end of the bed member and raised walls extending upwardly from the infant support surface for operatively restricting the infant from rolling off the infant support surface, wherein the raised walls extend substantially about the periphery of the bed member defining, at a break therein near the foot end of the bed member, a gully for operatively directing fluid runoff from the infant support surface over the foot end of the bed member;

a base member on which the bed member is receivable, wherein the base member comprises a head end, an opposing foot end, a pair of opposing sides and a base surface on which the base member is operatively supportable, the base member defining:

(i) a first cavity extending from the foot end of the base member backwardly toward the head end thereof along a longitudinal axis passing through such foot and head ends of the base member; and (ii) a second cavity extending from one of the sides of the base member towards the opposing side thereof along a transverse axis passing through the sides of base member;

a first drawer defining an upper open end through which fluid runoff from the bed member is receivable within the first drawer, the first drawer being slidably movable along the first cavity between a retracted condition, wherein the first drawer is located substantially within the first cavity thereby to substantially conceal the upper open end of the first drawer, and an extended condition, wherein the first drawer extends substantially beyond the foot end of the base member and/or is movable entirely free therefrom thereby to expose the upper open end of the first drawer; and a second drawer slidably movable along the second cavity between a retracted condition, wherein the second drawer is located substantially within the second cavity, and an extended condition, wherein the second drawer extends substantially beyond the side of the base member and/or is movable entirely free therefrom, wherein the first drawer is shaped and sized such that even when the first drawer is in the retracted condition, at least a portion of the upper open end thereof extends longitudinally beyond the foot end of the bed member, beneath the gully, thereby to capture fluid runoff operatively falling there over.

2. The changing pod of claim 1 wherein the infant support surface of the bed member is padded for comfortably supporting the infant.

3. The changing pod of claim 2 wherein the infant support surface of the bed member is slip resistant.

4. The changing pod of claim 3 including a means for releasably securing the infant on the bed member, the releasable securing means being in the form of an adjustable strap.

5. The changing pod of claim 4 wherein the strap is anchored to the base member and includes, at each free ends thereof, co-operating clips for securing the strap in a closed loop fashion operably about the body of the infant, thereby to secure the infant in position on the bed member.

6. The changing pod of claim 1 wherein the second cavity extends across both of the sides of the base member, with the second drawer:

(i) being substantially cuboidal in shape having a major dimension as measured across its opposing retractable ends substantially the same as the width of the base member at the location thereon at which the second cavity is defined; and (ii) being slidably movable there along into the extended condition beyond each of the sides of the base member.

7. The changing pod of claim 6 wherein the second cavity and the second drawer respectively have substantially T-shaped cross-sections, with an upper portion of the second drawer:

(i) being operably captured by and slidable along an upper portion of the second cavity; and (ii) including a plurality of retention fingers being laterally movable between inward and outward positions relative to the second drawer, wherein the retention fingers are biased towards the outward position to frictionally ride along the upper portion of the second cavity so as to support the second drawer within the second cavity whether operably in the retracted or extended conditions.

8. The changing pod of claim 7 wherein the retention fingers are located near each of four corners of the second drawer, and further wherein the retention fingers are configured on the second drawer such that first free ends of each of the retention fingers lie closer to the opposing retractable ends of the second drawer, as compared to second hinged ends of each of the retention fingers lying closer to the middle of the major dimension of the second drawer.

9. The changing pod of claim 8 wherein the retention fingers are integrated with the second drawer via respective living hinges located at the second hinged ends of each of the retention fingers, about which living hinges the retention fingers are resiliently biased towards the outward position.

10. The changing pod of claim 9 wherein the base member, near each of its opposing sides and located within the second cavity thereof, defines retention sockets in which the first free ends of the retention fingers are releasably receivable such that with the second drawer in the fully retracted condition, the retention fingers releasably lock the second drawer in the base member.

11. The changing pod of claim 10 wherein the second drawer is divided into two or more compartments.

12. The changing pod of claim 11 including one or more light sources spaced from another at least about the head end of the base member, the light sources being powered by a rechargeable power source housed in the base member.

13. The changing pod of claim 12 including a means for adjusting the intensity of the light sources.

14. The changing pod of claim 13 wherein the light sources are light-emitting diodes.

15. A changing pod for an infant, the changing pod comprising:

a bed member having a head end, an opposing foot end, a pair of opposing sides;

an infant support surface formed by the bed member, the infant support surface at least partially sloping downwardly towards the foot end of the bed member;

raised walls of the infant support surface extending upwardly for operatively restricting the infant from rolling off the infant support surface, wherein the raised walls extend substantially about the periphery of the bed member defining, at a break therein near the foot end of the bed member, a gully for operatively directing fluid runoff from the infant support surface over the foot end of the bed member, a base member on which the bed member is mounted, wherein the base member comprises a head end, an opposing foot end, a pair of opposing sides, and a base surface on which the base member is operatively supportable, the base member defining a first cavity extending from the foot end of the base member backwardly toward the head end thereof along a longitudinal axis, and a second cavity extending from one of the sides of the base member towards the opposing side thereof along a transverse axis;

a first drawer defining an upper open end, the first drawer being shaped to be inserted into the first cavity such that at least a portion of the upper open end extends longitudinally beyond the foot end of the bed member, beneath the gully, to capture fluid runoff from the bed member is receivable within the first drawer; and a second drawer shaped to be inserted into the second cavity.

16. A changing pod for an infant, the changing pod comprising:

a bed member having a head end, an opposing foot end, a pair of opposing sides;

an infant support surface formed by the bed member, the infant support surface at least partially sloping downwardly towards the foot end of the bed member;

raised walls of the infant support surface extending upwardly for operatively restricting the infant from rolling off the infant support surface, wherein the raised walls extend substantially about the periphery of the bed member defining, at a break therein near the foot end of the bed member, a gully for operatively directing fluid runoff from the infant support surface over the foot end of the bed member, a base member on which the bed member is mounted, wherein the base member comprises a head end, an opposing foot end, a pair of opposing sides, and a base surface on which the base member is operatively supportable, the base member defining a first cavity extending from the foot end of the base member backwardly toward the head end thereof along a longitudinal axis; and a first drawer that includes an upper open end, the first drawer being shaped to be inserted into the first cavity such that the upper open end extends longitudinally, beneath the gully, at the foot end of the bed member to capture fluid runoff from the bed member into the first drawer.

* * * * *